US006557536B2

(12) United States Patent
Burgess

(10) Patent No.: US 6,557,536 B2
(45) Date of Patent: May 6, 2003

(54) SAFETY SHUT-OFF VALVE FOR CRANKCASE EMISSION CONTROL SYSTEM

(75) Inventor: Stephen F. Burgess, Escalon, CA (US)

(73) Assignee: Parker-Hannifin Corporation, Cleveland, OH (US)

( * ) Notice: Subject to any disclaimer, the term of this patent is extended or adjusted under 35 U.S.C. 154(b) by 38 days.

(21) Appl. No.: 09/863,853

(22) Filed: May 23, 2001

(65) Prior Publication Data

US 2001/0054418 A1 Dec. 27, 2001

Related U.S. Application Data

(60) Provisional application No. 60/206,879, filed on May 24, 2000.

(51) Int. Cl.[7] ..... F02M 25/00
(52) U.S. Cl. ..... 123/572
(58) Field of Search ..... 123/572, 573, 123/574, 41.86

(56) References Cited

U.S. PATENT DOCUMENTS

| | | | | |
|---|---|---|---|---|
| 3,834,365 A | | 9/1974 | Ussery | |
| 3,949,719 A | | 4/1976 | Bellanca et al. | |
| 4,050,237 A | | 9/1977 | Pall et al. | |
| 4,409,950 A | | 10/1983 | Goldberg | |
| 4,580,543 A | | 4/1986 | Aoki | |
| 4,947,806 A | * | 8/1990 | Speer et al. | 123/41.86 |
| 4,962,745 A | * | 10/1990 | Ohno et al. | 123/572 |
| 5,027,784 A | | 7/1991 | Osawa et al. | |
| 5,046,474 A | * | 9/1991 | Percy | 123/573 |
| 5,201,301 A | | 4/1993 | Re | |
| 5,564,401 A | | 10/1996 | Dickson | |

FOREIGN PATENT DOCUMENTS

| | | |
|---|---|---|
| DE | 42 14 324 | 11/1993 |
| DE | 198 01 608 | 7/1999 |
| EP | 0 506 571 A1 | 9/1992 |
| JP | 09088542 | 3/1997 |

* cited by examiner

*Primary Examiner*—Marguerite McMahon
(74) *Attorney, Agent, or Firm*—Christopher H. Hunter

(57) ABSTRACT

A closed crankcase emission control system for an internal combustion engine includes a replaceable filter element having a ring of filter media; a first end cap at one end of the media ring; a sump container defined by a second end cap at the other end of the media ring and a cup-shaped valve pan fixed to the second end cap; and a check valve in the valve pan to block blow-by gas flow directly into the filter element during engine operation, and to allow collected oil to flow out of the sump container during engine idle or shut-down. A shut off valve is provided to prevent oil from passing through the emission control system to the engine. The shut off valve comprises a cylindrical float member with a supporting body and a seal, where the body includes a guide member. The float member could also be a ball valve. The float member floats with the level of oil in the housing, and can fluidly seal against a valve seat to prevent oil passing to the engine. The shut off valve can be incorporated into the filter element, into a central support tube of the housing, or into the inlet or outlet fittings for the housing. Supporting structure is provided to maintain the float member in a proper orientation. A pressure relief valve can also be provided upstream from the shut-off valve to relieve system pressure when the shut-off valve is closed.

32 Claims, 15 Drawing Sheets

SAFETY SHUT-OFF VALVE FOR CRANKCASE EMISSION CONTROL SYSTEM

CROSS-REFERENCE TO RELATED CASES

The present application claims the benefit of the filing date of U.S. Provisional Application Ser. No. 60/206,879; filed May 24, 2000, which is incorporated herein by reference.

FIELD OF THE INVENTION

The present invention is directed to a crankcase emission control system. The crankcase emission control system is useful for heavy internal combustion engines, such as diesel engines.

BACKGROUND OF THE INVENTION

Emission control systems for internal combustion engines have become increasingly important as concerns over environmental damage and pollution have risen prompting legislators to pass more stringent emission controls. Much progress has been made in improving exhaust emission control systems. However, crankcase emission control systems have been largely neglected.

Crankcase emissions result from gas escaping past piston rings of an internal combustion engine and entering the crankcase due to high pressure in the cylinders during compression and combustion. As the blow-by gasses pass through the crankcase and out the breather, the gasses become contaminated with oil mist, wear particles and air/fuel emissions. Some diesel engines discharge these crankcase emissions to the atmosphere through a draft tube or similar breather vent, which contributes to air pollution. The crankcase emissions can also be drawn into the engine intake system causing internal engine contamination and loss of efficiency.

Relatively few heavy diesel engines have crankcase emission controls. Crankcase emission control systems filter the crankcase particulate emissions and separate the oil mist from the crankcase fumes. The separated oil is collected for periodic disposal or return to the crankcase. The crankcase emission control systems increase engine performance and decrease maintenance intervals and site/critical engine component contamination. The systems are also becoming increasingly important in reducing air pollution.

Crankcase emission control systems may be "open" or "closed" systems. In open systems, the cleaned gases are vented to the atmosphere. Although open systems have been acceptable in many markets, they pollute the air by venting emission to the atmosphere and can suffer from low efficiency. In a closed system, the crankcase breather is connected to the inlet of the closed crankcase emission control system. The outlet of the system is connected to the engine air inlet, where the filtered blow-by gas is recycled through the combustion process. Closed systems eliminate crankcase emissions to the atmosphere, meet strict environmental regulations, and eliminate site and external critical component contamination.

One of the first closed systems, developed by Diesel Research, Inc. of Hampton Bays, N.Y., includes a two-component crankcase pressure regulator and a filter. The filter removes particles to prevent contamination of turbochargers, aftercooler, and internal engine components. The pressure regulator maintains acceptable levels of crankcase pressure over a wide range of crankcase gas flow and inlet restrictions. Because the pressure regulator is a separate component from the filter, additional plumbing and space is required for the system. This creates significant installation and maintenance costs for the system.

A recent improvement to closed crankcase emission control systems is shown in U.S. Pat. No. 5,564,401, also owned by Diesel Research, Inc. In this system, a pressure control assembly and a filter are integrated into a single compact unit. The pressure control assembly is located in a housing body and is configured to regulate pressure through the system as well as agglomerate particles suspended in the blow-by gasses. Inlet and outlet ports direct the blow-by gasses into and out of the housing body from the engine block. A filter housing enclosing a replaceable filter element is removably attached to the housing body to separate any remaining oil from the blow-by gasses. The filter element can be easily removed from the filter housing for replacement, after removing the filter housing from the housing body. The separated oil drains down and collects in a reservoir at the bottom of the filter housing. An oil drain is located in the bottom wall of the filter housing, and includes a free-floating (one-way) check valve. The check valve is connected through a separate return line to the oil pan or engine block to return the collected oil to the engine. The system is compact and combines various components into a single integrated unit, is efficient, and is simple and inexpensive to manufacture.

While there are many advantages to the emission control system shown in the Diesel Research patent, the oil collecting on the inside surface of the media ring drains down onto the lower end cap, and then must make its way radially outward through the media, before it then drips down into the oil reservoir area for return to the engine. The return path through the media can be obstructed as the filter element becomes spent, which results in the oil being retained in the element and thereby less oil being returned to the engine crankcase. Spillage of the oil can occur during an element change, which can create handling issues.

The check valve in the housing for the Diesel Research system can also become clogged and/or worn over time, and have to be removed and replaced. Since the check valve is part of the filter housing, this generally means replacement of the entire (relatively expensive) filter housing, and also keeping a separate maintenance schedule for the filter housing/check valve.

Still further, the return line for the oil is a separate component from the crankcase emission line from the engine. This requires separate plumbing between the engine and emission control system, and generally increases the material, installation and maintenance costs associated with the system.

A further improved filter assembly for a crankcase emission control system is shown in U.S. Pat. No. 6,161,529, owned by the assignee of the present invention and which is incorporated herein by reference. In this assembly, oil collected in the filter drains directly into a sump chamber (not through the filter media), and can be returned through a check valve to the engine. The oil drains back through the crankcase emissions line, which reduces the number of lines needed to and from the engine. The check valve is also integral with the filter element, and is thereby replaced at the same time the filter element is replaced. Thus, this assembly addresses some of the drawbacks of the Diesel Research System.

Nevertheless, in certain application, it has been found that a volume of engine oil can be drawn into the air intake of the diesel engine, such as if the vehicle is located on an extreme angle, or if a roll-over occurs. In these situations, oil can accumulate above the cylinder head, and if it flows into the crankcase emission control system, the engine can run uncontrollably on the ingested oil.

Thus, it is therefore believed there is a demand in the industry for a still further improvement, most notably an improved crankcase emission control system which prevents oil from passing through the system and being ingested by the engine; and still provides a system that is compact and combines various components into a single integrated unit, is efficient, and is simple and inexpensive to manufacture.

SUMMARY OF THE PRESENT INVENTION

The present invention provides a novel and unique crankcase emissions control system. Oil collecting in the cylinder head is prevented from passing through the emission control system by a shut-off valve. The shut-off valve floats on the oil surface, and rises with the oil to close the air intake. The shut off valve is of simple construction, and can be combined with the filter assembly, in a center tube integral with the housing, or in inlet or outlet fittings for the crankcase emissions control system. A pressure relief valve can also be provided upstream from the shut-off valve to relieve excess system pressure.

According to a first embodiment of the present invention, the shut off valve comprises a cylindrical float member with a supporting body and a seal. The body includes a guide member to maintain the float member in a proper orientation with respect to the gas passage leading to the engine. The float member floats with the level of oil in the housing of the emission control system, and when the oil level increases to the level of the gas passage, the seal on the float member fluidly seals against a valve seat at the opening to the passage to prevent oil passing to the engine. When the oil level drops, the float member drops as well, and allows the gas to again pass to the engine.

The shut off valve can be incorporated in the filter element, and in such case it is preferred that one end cap of the element include a well area to support an guide the float member; or alternatively, the shut off valve can be incorporated into a central support tube integral with the housing of the emissions control system. The central support tube would likewise have appropriate structure to guide the float member. According to further embodiments, the float member can be a hollow ball and be guided within a passage into position against a valve seat. The shut-off valve in these embodiments can be incorporated into the cover of the crankcase, or into inlet or outlet fittings to the housing.

The pressure relief valve can be provided upstream from the shut-off valve to relieve excess pressure in the system when the shut-off valve is in a closed position. The pressure relief valve and shut-off valve can be mounted together in the inlet fitting or in the outlet fitting, or the pressure relief valve can be located in the inlet fitting, while the shut-off valve is located in the outlet fitting.

The crankcase emission control assembly of the present invention thereby prevents oil passing through the crankcase emission control system and being ingested by the engine; and still provides a system that is compact and combines various components into a single integrated unit, is efficient, and is simple and inexpensive to manufacture.

Further features of the present invention will become apparent to those skilled in the art upon reviewing the following specification and attached drawings.

DETAILED DESCRIPTION OF THE PREFERRED EMBODIMENT

Figure 1:
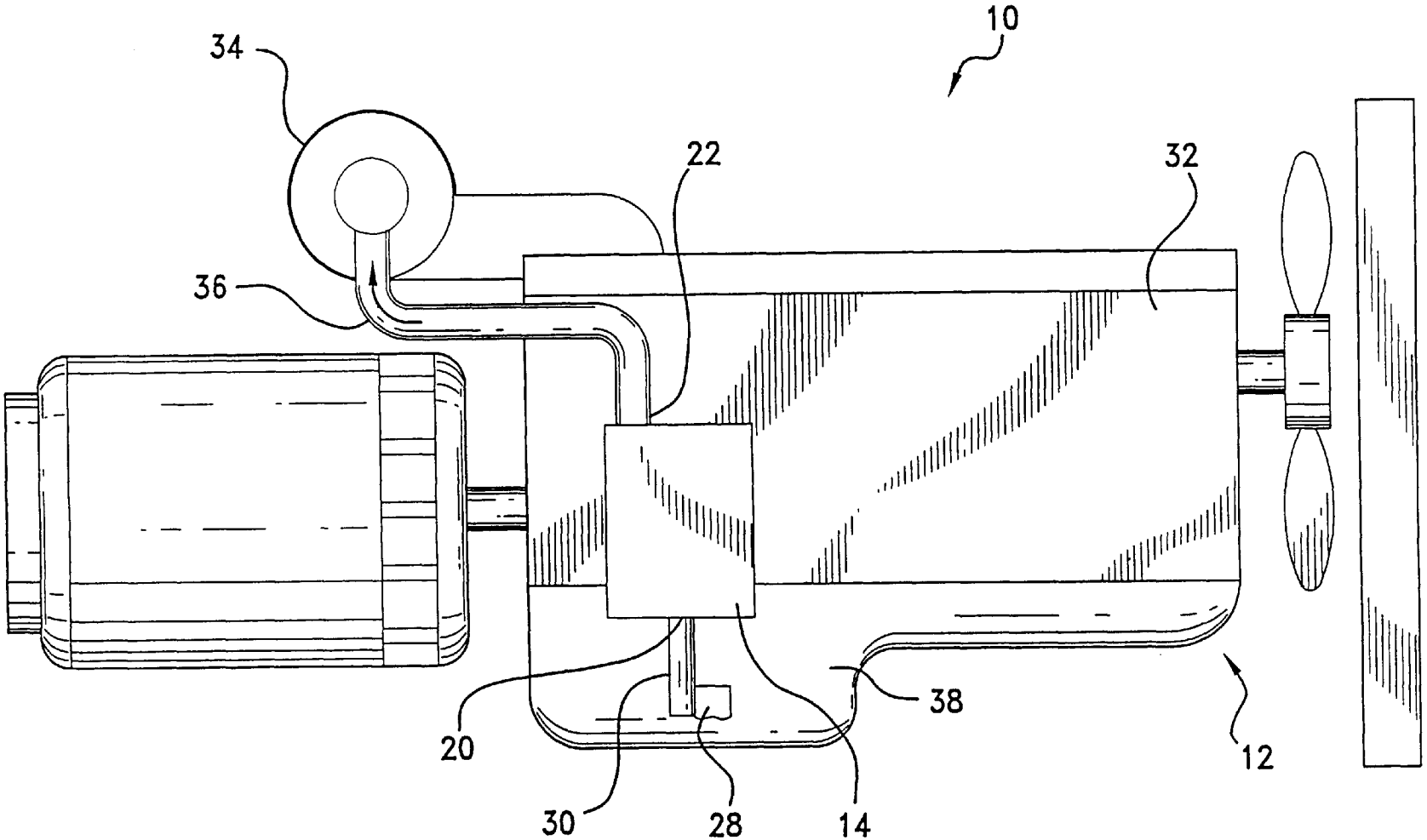
FIG. 1 is an illustration of an internal combustion engine having a closed crankcase emission control system according to the present invention.

Referring to the drawings, and initially to FIG. 1, a closed crankcase system is indicated generally at 10. The system includes an internal combustion engine, indicated generally at 12, and an integrated crankcase emission control system 14. The integrated crankcase emission control system 14 includes a filter and a pressure control assembly, as will be described below.

The crankcase emission control system 14 has a gas inlet 20 and a gas outlet 22. The gas inlet 20 is connected to the engine crankcase breather 28 via an inlet hose 30 and receives contaminated oily gas from the engine crankcase 32. The crankcase emission control system 14 separates the contaminated oily gas, agglomerates small particulates to form larger particulates, and filters the large particulates.

The cleaned crankcase emissions exit from the gas outlet 22 and enter the engine air intake 34 for combustion via an outlet hose 36. The separated oil is returned to the oil pan 38 through inlet hose 30.

Figure 2:
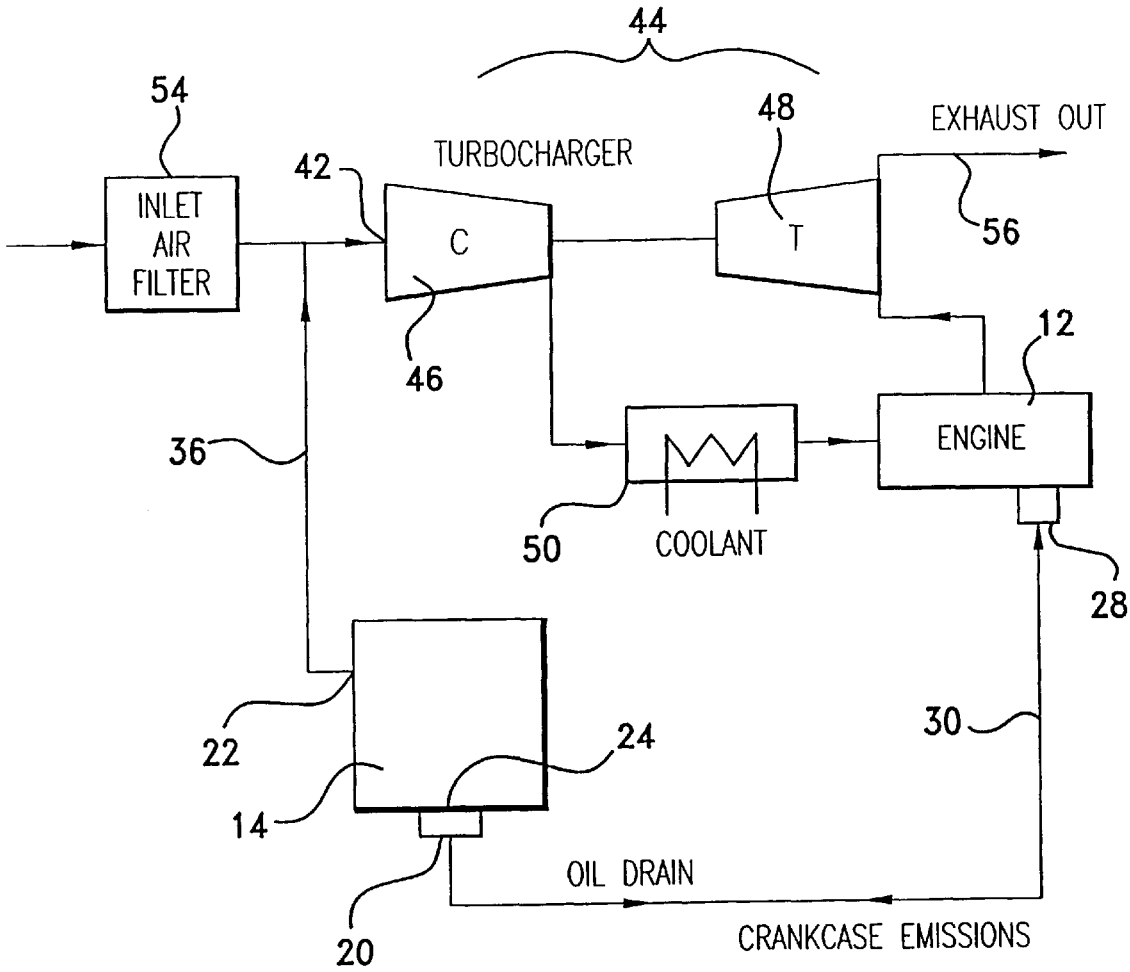
FIG. 2 is a block diagram representation of the closed crankcase emission control system shown in FIG. 1.

FIG. 2 is a block diagram representation of FIG. 1, wherein the cleaned crankcase emissions enter an induction system such as the air intake 42 of a turbocharger system, indicated generally at 44. The turbocharger system includes a compressor 46, a turbocharger 48, and an aftercooler 50. The engine also receives clean air through a silencer filter 54, while the exhaust manifold (not shown) of the engine and the turbocharger 48 are coupled to an exhaust line 56.

Figure 3:
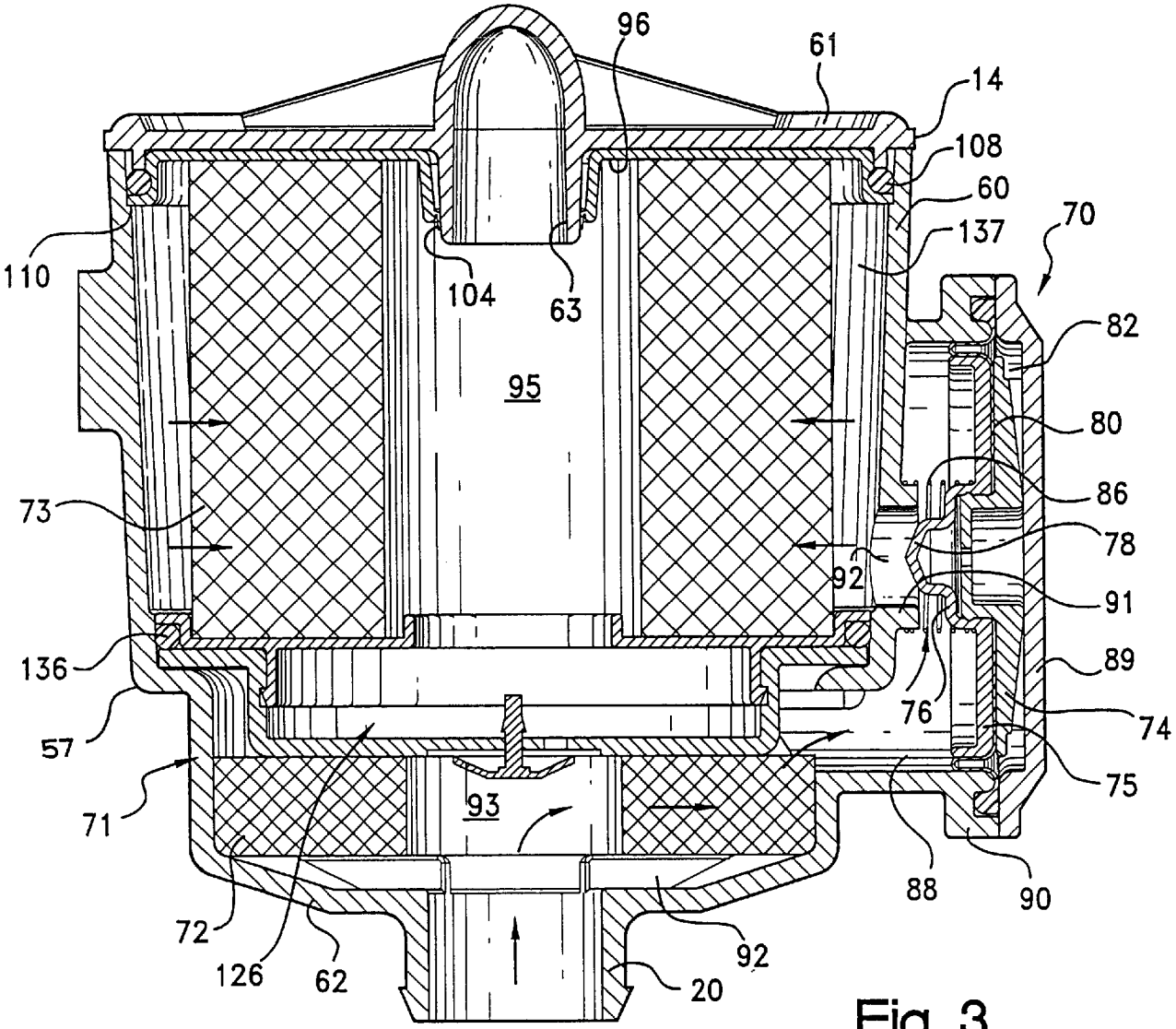
FIG. 3 is a cross-sectional side view of a closed crankcase emission control system with a filter assembly constructed according to the present invention.
Figure 4:
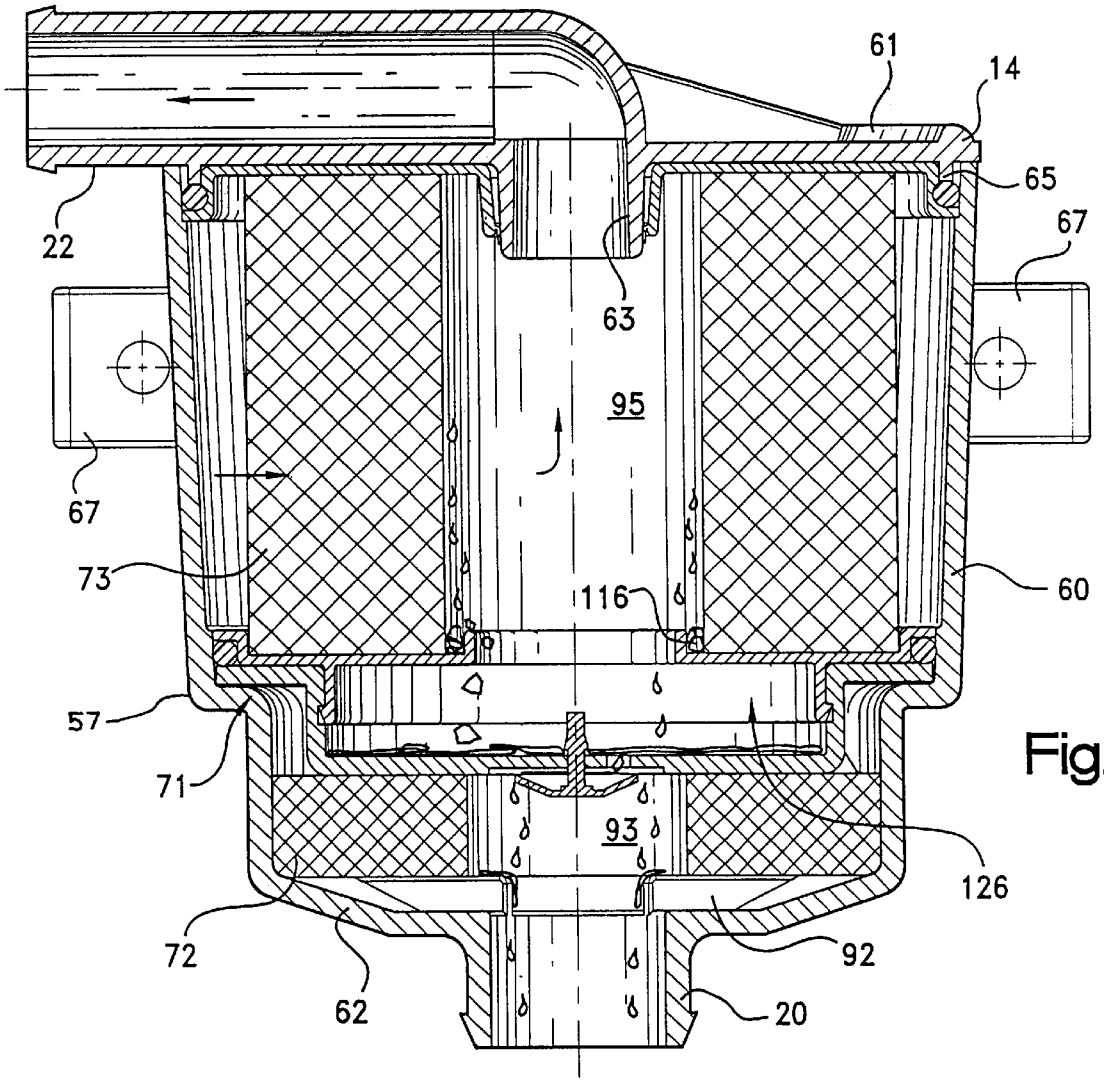
FIG. 4 is a cross-sectional side view similar to FIG. 3 but where the crankcase emission control system is rotated 90 degrees for clarity.

FIGS. 3 and 4 show a cross-section of the crankcase emission control system 14 for the engine. The crankcase emission control system 14 includes a housing 57 including a cylindrical sidewall 60 and a removable cover 61. The gas inlet 20 is located in a bottom wall 62 of the sidewall 60, while the gas outlet 22 is located in cover 61. Gas outlet 22 includes a cylindrical sleeve 63 which extends inwardly into the crankcase emission control system 14. The gas inlet 20 and gas outlet 22 may have barbs to facilitate attachment of the appropriate inlet and outlet hoses.

Cover 61 is removably attached to sidewall 60 in an appropriate manner. For example, cover 61 may have a downwardly-extending cylindrical flange 65 with outwardly-directed threads, which mate with inwardly-directed threads at the upper end of housing 14. In this manner, the cover 61 can be easily screwed onto or off of the sidewall 60. The housing can include appropriate attachment flanges 67 to allow the crankcase emission control assembly to be mounted at an appropriate location on the engine.

The housing contains a pressure control assembly, indicated generally at 70 (FIG. 3), and a filter assembly, indicated generally at 71. Pressure control assembly 70 acts as a pressure regulator and an inertial separator and agglomerator for the blow-by gasses received from the engine. The filter assembly separates oil suspended in the blow-by gasses, and includes a primary breather filter 72 for separating heavy oil droplets before the blow-by gasses reach the pressure control assembly 70; and a crankcase filter 73 for separating any remaining smaller droplets after the gasses have passed through the pressure control assembly 70, as well as any particulate matter in the gasses.

The pressure control assembly 70 is mounted on the side of housing 14 and comprises a valve having a valve body 74 connected to a valve head 75. In turn, the valve head 75 is connected to a valve plug 76. A valve guide 78 is connected to the valve plug 76. An annular rolling diaphragm 80 is located circumferentially around the valve body 74. The diaphragm 80 separates the valve body 74 from an annular chamber 82 that is vented to the atmosphere. A coil spring 86 is located around the valve plug 76, between the valve body 74 and a lower surface of an annular inlet chamber 88. The valve body 74, valve head 75, valve plug 76, valve guide 78, diaphragm 80 and coil spring 86 are enclosed between a cover 89 and a cylindrical flange 90 formed in one piece with sidewall 60. Diaphragm 80 serves as a fluid seal between cover 89 and flange 90.

The inlet chamber 88 of the pressure control assembly 70 is fluidly connected to gas inlet 20 through breather filter 72. In addition, an opening of a cylindrical body channel 91 is located at the center of the inlet chamber 88. Body channel 91 defines an outlet passage 92 from the pressure control assembly to the crankcase filter 73, and consequently to gas outlet 22. The valve guide 78 is located within the body channel 91.

The body channel 91 has an outer end defining a valve seat opposite the valve plug 76. The valve seat of channel 91, combined with the valve plug 76 and valve head 74, define a variable orifice of an inertial separator and agglomerator. The valve plug 76 is moved toward and away from the valve seat of channel 91, depending upon the pressure received through the gas inlet 20. The pressure control assembly 70 keeps the pressure in the inlet chamber 88 and engine crankcase constant. Oil droplets also impinge upon valve plug 76, collect, and then drip down toward the bottom of the housing 14. Additional detail of the pressure control assembly can be found in U.S. Pat. No. 5,564,401, which is incorporated herein by reference.

The breather filter 72 of the filter assembly 71 comprises an annular filter media formed of appropriate material (e.g., steel mesh) that is supported on a series of radial fins or ridges 92 at the bottom end of the sidewall 60. The breather filter is typically fixed within the housing in an appropriate manner, and is typically not replaced, or at least not replaced at the intervals typically found with the crankcase filter 73. The breather filter has a central opening 93 allowing unobstructed access to gas inlet 20. Blow-by gasses entering gas inlet 20 initially pass radially outward through the breather filter 72, where heavy oil droplet are removed in the breather filter, collect, and then drain downwardly through gas inlet 20 back to the engine. The blow-by gasses then pass to inlet chamber 88 of pressure control assembly, and through the pressure control assembly to crankcase filter 73. As described above, additional oil suspended in the blow-by gasses collects on the valve plug 76, drips downwardly, and drains through the large mesh structure of filter breather 72, and then through gas inlet 20 back to the engine.

Figure 5:
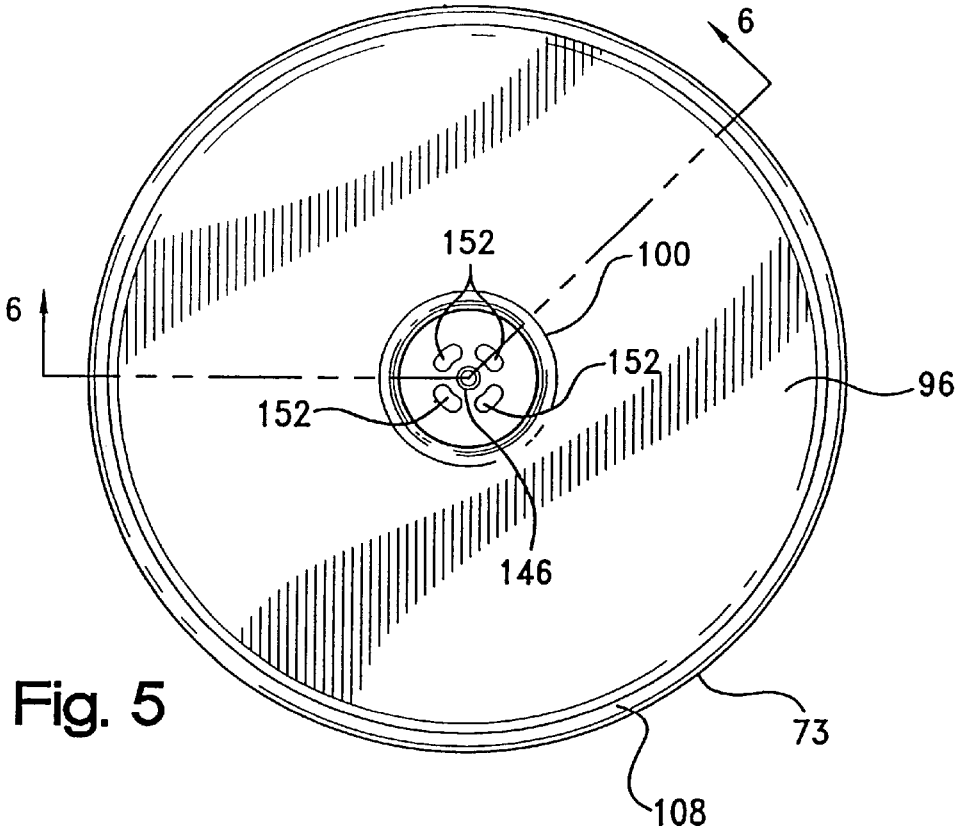
FIG. 5 is an end view of the filter element for the crankcase emission control system of FIG. 3.
Figure 6:
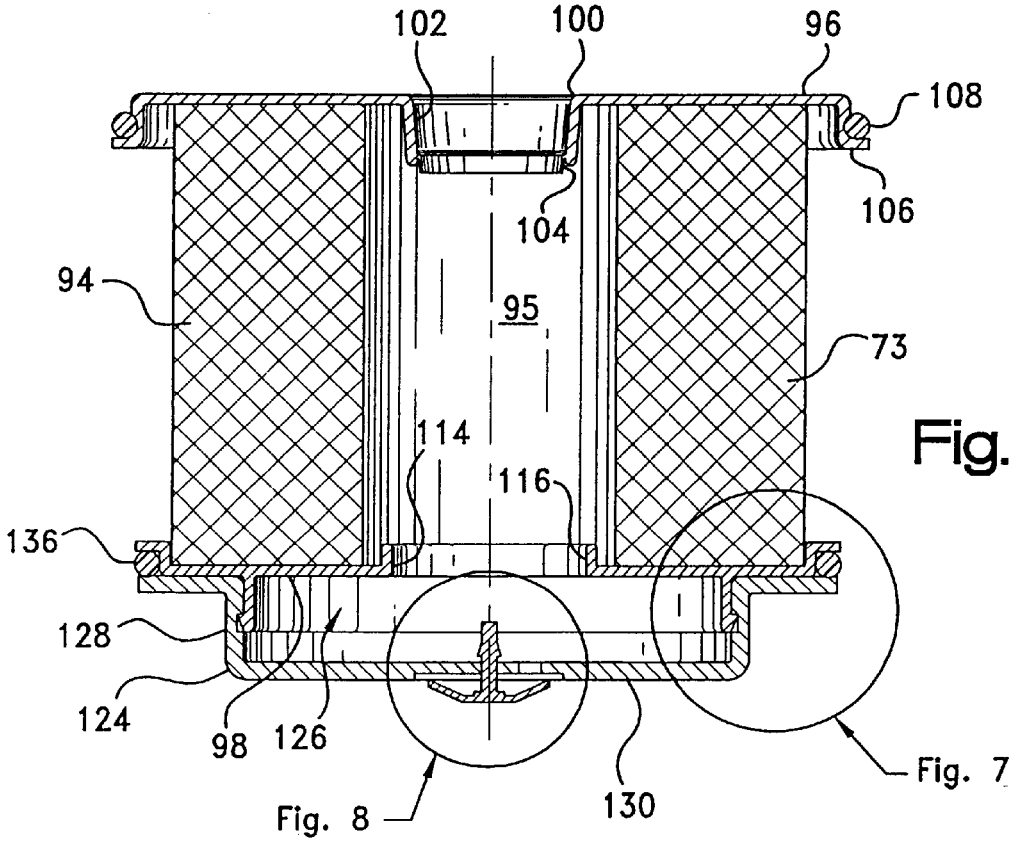
FIG. 6 is a cross-sectional side view of the filter element, taken substantially along the plane described by the lines 6—6 of FIG. 5.

The blow-by gasses with any remaining suspended oil then passes radially inward through crankcase filter 73. Referring now to FIGS. 5 and 6, the crankcase filter 73 comprises a replaceable filter element having a ring of filter media 94 circumscribing a central cavity 95. The ring of filter media can be formed from any material appropriate for the particular application. First and second impermeable end caps 96, 98 are provided at opposite end of the media, and are bonded thereto with an appropriate adhesive or potting compound. First (upper) end cap 96 has an annular configuration defining a central opening 100. Opening 100 is slightly larger than cylinder 63 (FIG. 3) of cover 62 such that the cylinder can be received in this opening. The upper end cap 96 includes a cylinder 102 outwardly bounding and extending inwardly from opening 100 into central cavity 95. Cylinder 102 of upper end cap 96 surrounds cylinder 63 of cover 62, and includes a resilient, annular, radially-inward directed seal 104 at its inner distal end which provides a fluid seal between the cover 62 and the first end cap 96 (see, e.g., FIG. 3). While seal 104 is illustrated as being unitary with cylinder 102, it is also possible that this seal could be a separate seal (such as an O-ring), supported within a channel or groove formed in cylinder 102 (or on cylinder 63 of cover 62).

The first end cap 96 also has a short cylindrical skirt with a radially-outward directed annular flange 106 around the periphery of the end cap. A resilient annular seal or O-ring 108 is carried by this skirt and flange, and provides a fluid seal between the sidewall 60, cover 62 and the first end cap 96 (see. e.g., FIG. 3). Sidewall 60 can have an inner annular shoulder 110 (FIG. 3) that closely receives the distal end of flange 106 to orient and support the filter element in the housing.

Figure 7:
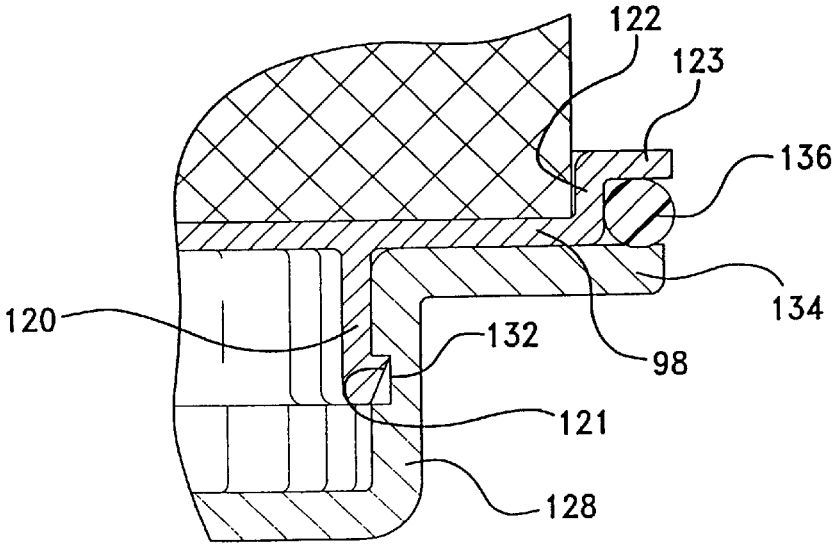
FIG. 7 is an enlarged cross-sectional side view of one portion of the filter element of FIG. 6.

The second end cap 98 also has an annular configuration defining a central opening 114. A short cylinder 116 outwardly bounds and extends inwardly from opening 114 into central cavity 95. As shown also in FIG. 7, a short cylinder 120 also extends downwardly away from the second end cap at a location toward the periphery of the end cap. Cylinder 120 includes an annular, radially-outward projecting catch or barb 121 around the outer circumference of the cylinder, toward its lower distal end. A short cylindrical flange 122 projects upwardly around the periphery of second end cap 98, and a short annular flange 123 then projects radially outward from flange 122.

A cup-shaped valve pan 124 is fixed to the second end cap 98, and together with the second end cap, defines a sump container integral with the filter element, that is, separate from the housing enclosing the element. The sump container includes an inner sump chamber, indicated generally at 126. Valve pan 124 has a cylindrical sidewall 128 and an integral (and preferably unitary) end wall 130. Cylindrical sidewall 128 closely receives the cylinder portion 120 of second end cap 98, and includes an inwardly-directed, circumferentially-extending channel 132 which receives catch 122 on cylinder portion 120. Catch 121 and channel 132 enable the valve pan 124 to be easily assembled with second end cap 98 in a permanent relation thereto. While catch 121 and channel 132 provide one means for fixing valve pan 124 to second end cap 98, sidewall 128 of valve pan 124 can alternatively be fixed to second end cap 98 by other appropriate means, such as with an adhesive or by sonic welding; or could even be formed unitarily (in one piece) with second end cap 98.

Valve pan 124 further includes a radially-outward projecting flange 134 at the upper end of the valve pan, which extends in surface-to-surface flush relation to second end cap 98, radially outward from cylinder 120. When the valve pan 124 is fixed to the second end cap 98, flanges 122 and 123 on second end cap 98, and flange 134 on valve pan 124, define an annular groove. A resilient annular seal or O-ring 136 is located in this groove in outwardly-bounding relation to the sump container, and provides a fluid seal between valve pan 124, second end cap 98 and sidewall 60 (see, e.g., FIG. 3). The second end cap 98 can also be radially smaller than illustrated such that the flange 134 of valve pan 124 is located in surrounding relation to the second end cap and in direct supporting relation with media ring 94. In this case, media 94 can be adhesively attached to second end cap 98 as well as flange 134 of valve pan 124, and seal 136 would be carried only by valve pan 124.

When filter element 73 is located in the housing, seals 108 and 136 fluidly seal against sidewall 60 on opposite sides of opening 92. A peripheral chamber 137 is thereby defined between the crankcase filter 73 and the sidewall 60 of the housing. Gasses passing through pressure control assembly 70 must thereby enter the peripheral chamber 137 and pass radially inward through media 94, without bypassing the element. Any oil remaining in the gasses is separated by the media 94, and collects on the inside surface of the media in central cavity 95. The oil then drips down into the area between the filter media 94 and the cylinder 116 of the lower end cap 98, as illustrated in FIG. 4. The oil eventually collects above the level of the cylinder, at which point it then drips downwardly into the sump chamber 126 and is contained by the valve pan.

Figure 9:
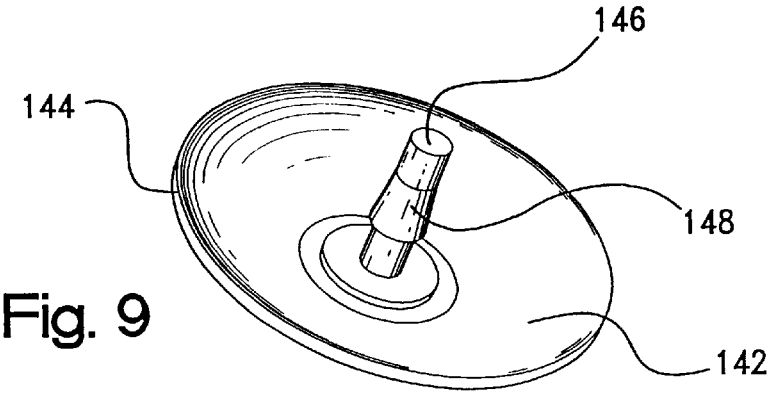
FIG. 9 is an elevated perspective view of the check valve element for the check valve of the filter element.
Figure 8:
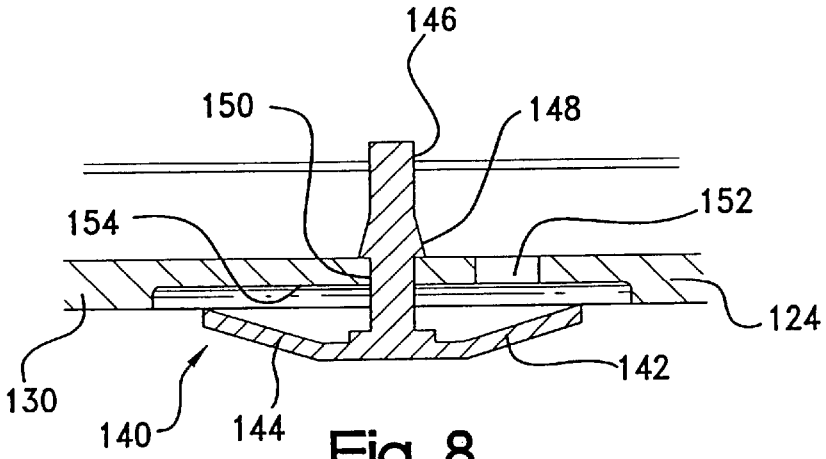
FIG. 8 is an enlarged cross-sectional side view of another portion of the filter element of FIG. 6.

The sump container further includes an integral, one-way check valve, indicated generally at 140 in FIG. 8, which prevents blow-by gasses from directly entering sump chamber 126 without passing through filter assembly 71, but which allows collected oil to drain out from the sump chamber 126 and return to the engine. To this end, referring now to FIGS. 8 and 9, the check valve includes a T-shaped resilient valve member 142 which includes a slightly concave circular head portion 144 and an integral cylindrical post or base portion 146. Post 146 includes a radially-outward projecting barb or shoulder 148, along the length of the post. Valve member 142 is preferably formed in one piece from an appropriate material.

The cylindrical post 146 of the valve member is slidingly received within a circular hole 150 formed centrally in the bottom wall 130 of the valve pan 124, with the valve head 144 located exterior to the valve pan 124. The post 146 has a dimension such that it can be forced through the hole with barb 148 also compressing and passing through hole 150, but the outwardly-projecting barb 148 prevents the valve element from being thereafter removed from the hole. As shown in FIG. 5, a series of flow or drain openings 152 are formed in an annular configuration in the bottom wall 130 of the valve pan. Flow openings 152 fluidly connect sump chamber 126 with central opening 93 in breather filter 72, and hence with gas inlet 20. When the valve member is in the position shown in FIGS. 4 and 8, that is, an open position, oil collected in the sump chamber 126 can pass through the flow openings 152, around the valve head 144 of the valve member 142, into central opening 93 in breather filter 72, and then to the gas inlet. Barb 148 on post 146 allows the valve member to slide into the position shown in these Figures, but prevents the valve member from entirely falling out of or being removed from the hole 150. The oil then drains back to the engine drain pan through the gas inlet 20. While four such flow openings 152 are shown, this is merely for illustration purposes, and the number and dimension of the flow openings will depend upon the particular application, as should be appreciated.

When the valve member 142 is in the position shown in FIG. 3, that is a closed position, the valve head 144 is pressed against the outer surface of the valve pan 124, and blocks the flow through flow openings 152. A slight recess 154 can be provided on the outer surface of the valve pan surrounding the flow openings 152 to facilitate a fluid-tight seal. The pressure of the blow-by gasses received in gas inlet 20 is typically greater than the pressure of the oil collected in the sump chamber 126, and the valve member is therefore generally maintained in a closed position during engine operation. However, during engine idle, or non-operation, pressure received through gas inlet 20 drops, and any oil collected in the sump chamber 126 flows through openings 152 and forces the valve head to the open position. The check valve thereby acts to prevent blow-by gasses from directly entering the sump chamber 126 (and thereby by-passing the filter assembly and possibly harming the engine) during engine operation, but allows collected oil to drain back to the engine to maintain an appropriate oil level in the engine.

The check valve 140, being a part of the filter element, is removed and replaced when the element is removed and replaced. This maintains a fresh check valve in the emission control system, and thus reduces the likelihood that the check valve needs to be independently inspected and replaced. Obviously the sump container is likewise removed with the filter element when the filter element is removed and replaced.

During operation of the engine 12 (FIG. 1), the engine air intake 34 or the turbo air intake 42 (FIG. 2) of a turbocharged engine, which is connected to the gas outlet 22, creates a vacuum in the central cavity 95 of the crankcase filter 73. The pressure control assembly 70 keeps the pressure in the gas inlet 20 and engine crankcase constant. In addition, as indicated above, the breather filter initially separates larger oil droplets, while oil in the blow-by gasses also coats the valve plug 76. In either case, the oil drains down, and is returned to the engine.

Because oil is removed in the breather filter 72 as well as in the pressure control assembly 70, a fine filter media capable of filtering very fine particulates is not needed for the crankcase filter 73. Instead, efficient filtering is obtained using a coarser filter media with less pressure drop. The coarser filter is less expensive than fine filters, clogs less often, and requires less pressure drop for effective filtration. Thus, cost is reduced and maintenance intervals to replace the filter are increased. In addition, a large pressure drop for proper filtration is no longer required.

Particulate and oil-free crankcase emissions leave the filter media 73 and exit from the gas outlet 22. The cleaned crankcase emissions are then provided to the engine air intake 34 (FIG. 1) or the turbo air intake 42 (FIG. 2) for combustion.

Figure 10:
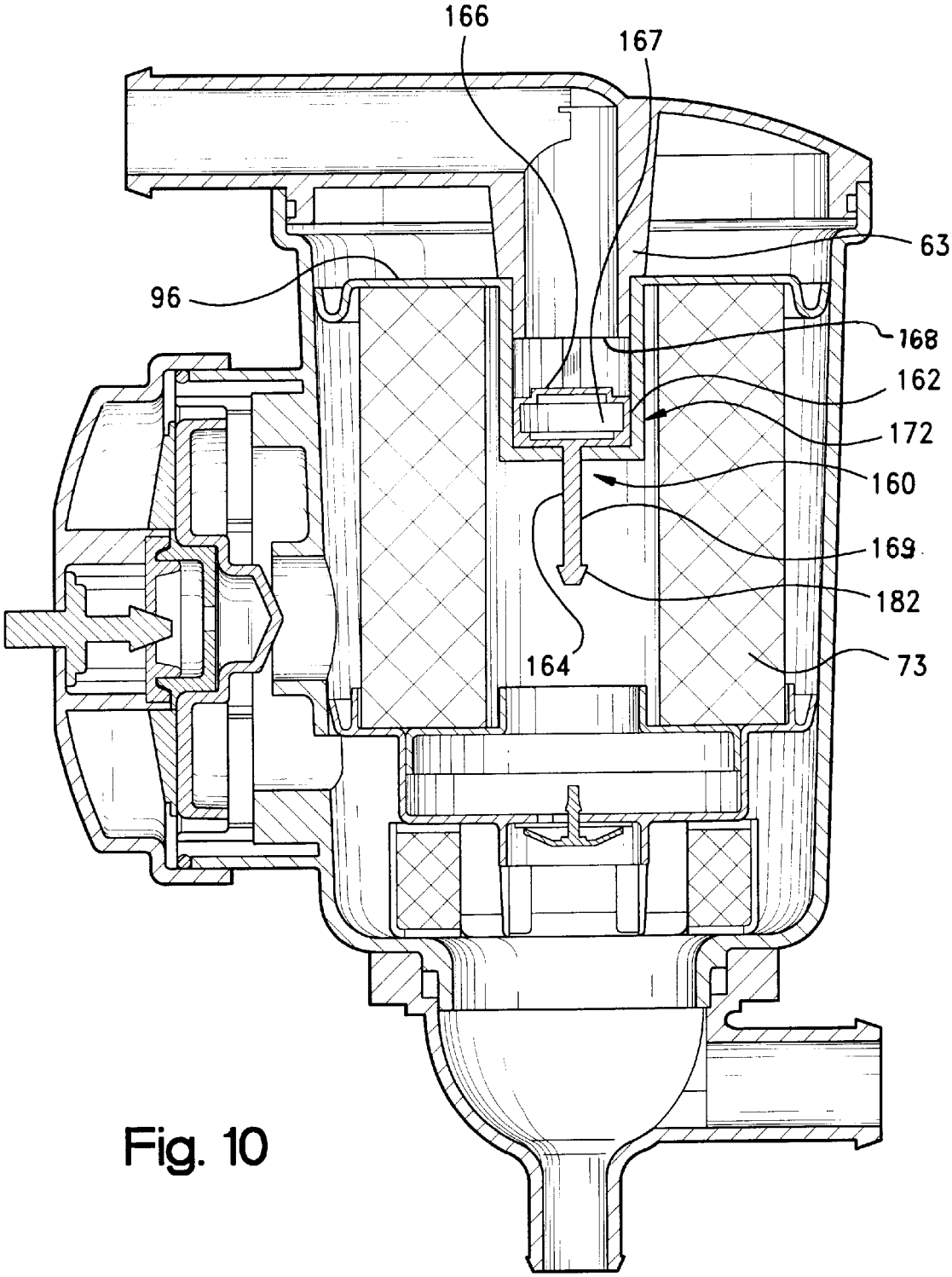
FIG. 10 is a cross-sectional side view of the crankcase emission control system, showing the shut-off valve of the present invention.
Figure 11:
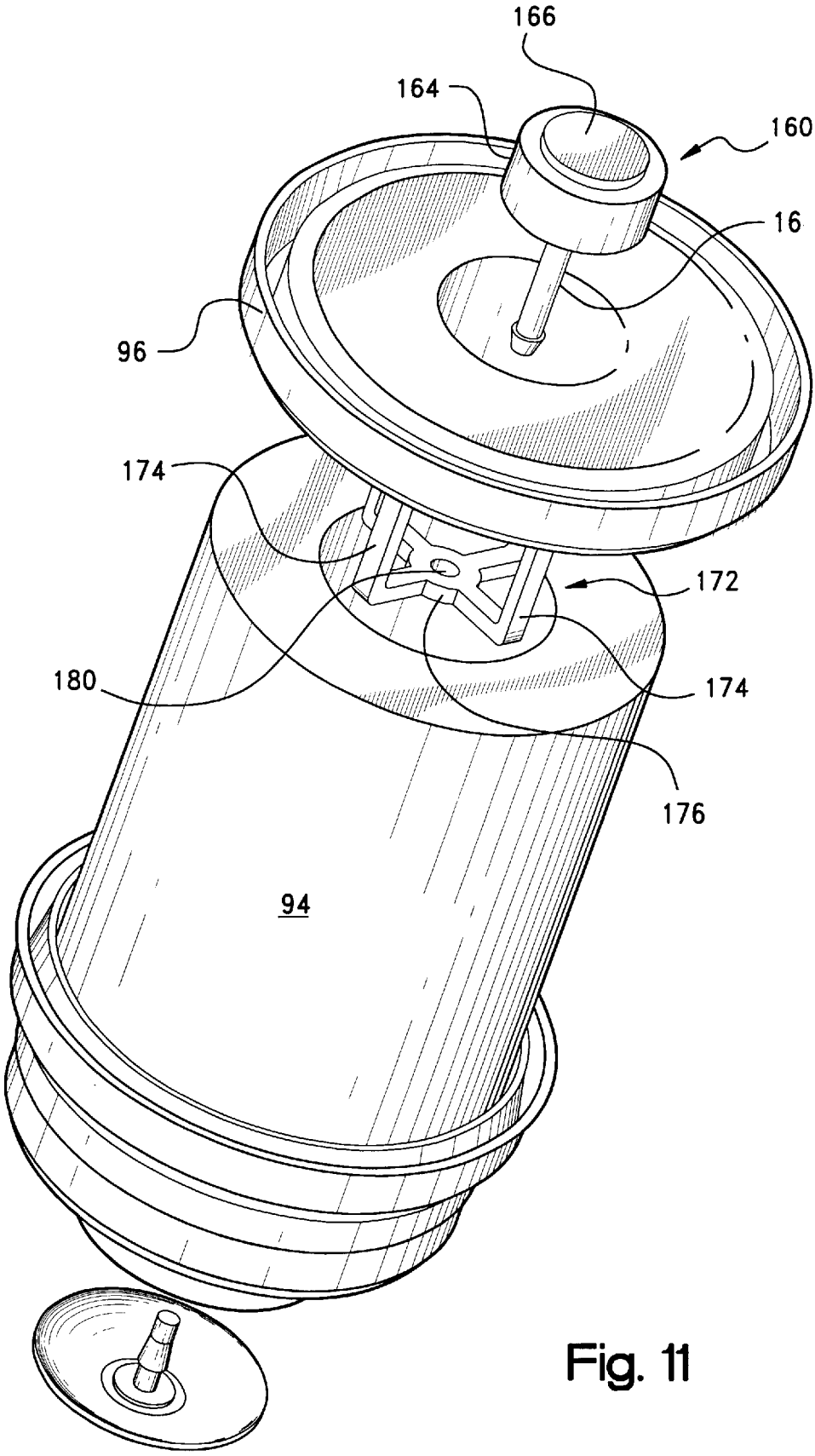
FIG. 11 is an elevated perspective view of the replaceable filter element for the crankcase emission control system of FIG. 10.

Referring now to FIGS. 10 and 11, a shut off valve is shown for preventing any oil collecting in the emission control system from passing through outlet passage 63, particularly if the vehicle is supported at an extreme angle, or during rollover conditions. The shut off valve is indicated generally at 160, and includes a cylindrical float member 162 with a supporting body 164 and a seal 166. Supporting body 164 is generally cup-shaped with an open upper end, and the seal is press-fit or otherwise fixed within the open end of the body. An empty cavity 167 is defined with the supporting body 164 and seal 166. The seal has circular outer sealing surface with a configuration sufficient to seal against the circular open end of passage 63, which defines a valve seat, indicated at 168. Alternatively, although not shown, the seal could engage a portion of the end cap, for example an annular, radially-inward projecting shoulder in well area 172, to prevent flow into the passage 63.

The body 164 includes an elongated cylindrical guide member 169 to maintain the float member in a proper orientation with respect to the gas passage 63. In a first embodiment of the shut off valve, the shut off valve is supported by the upper end cap 96 of the crankcase filter 73. It is noted that FIG. 11 illustrates the end cap prior to being adhesively attached to the end of media 94. In any case, end cap 96 includes a well area, indicated generally at 172, comprising a series of elongated, axially-extending support posts 174, which support an end wall 176. A central circular opening 180 is provided in end wall 176. Guide member 169 is slidingly received in opening 180, supporting body 164 is closely received within posts 174, such that the float member is generally constrained to axial upward and downward movement. A catch 182 can be provided at the distal inner end of the guide member 170 which can be easily inserted into opening 180, but prevents the guide member from being inadvertently removed from opening 180.

The float member 162 floats with the level of oil in the housing of the emission control system. As the oil level increases in the housing, the seal 166 on the float member fluidly seals against the valve seat 168 to prevent oil passing to the engine. The empty cavity 167 in the float member ensures that the float member remains buoyed on the surface of the oil in the housing, and in fact, the float member seals against the gas passage 63 slightly before the oil reaches the gas passage. When the oil level drops, the float member 162 drops as well, and allows the gas to again pass to the engine. While not shown, it is preferred that the sealing surface of the float member, or of the valve seat, have a relief (e.g., a shallow channel or notch) to allow pressure equalization across the float member when the oil level drops. Otherwise, the float member could stay in the closed position, even after the oil recedes, by virtue of the vacuum in the engine.

Figure 12:
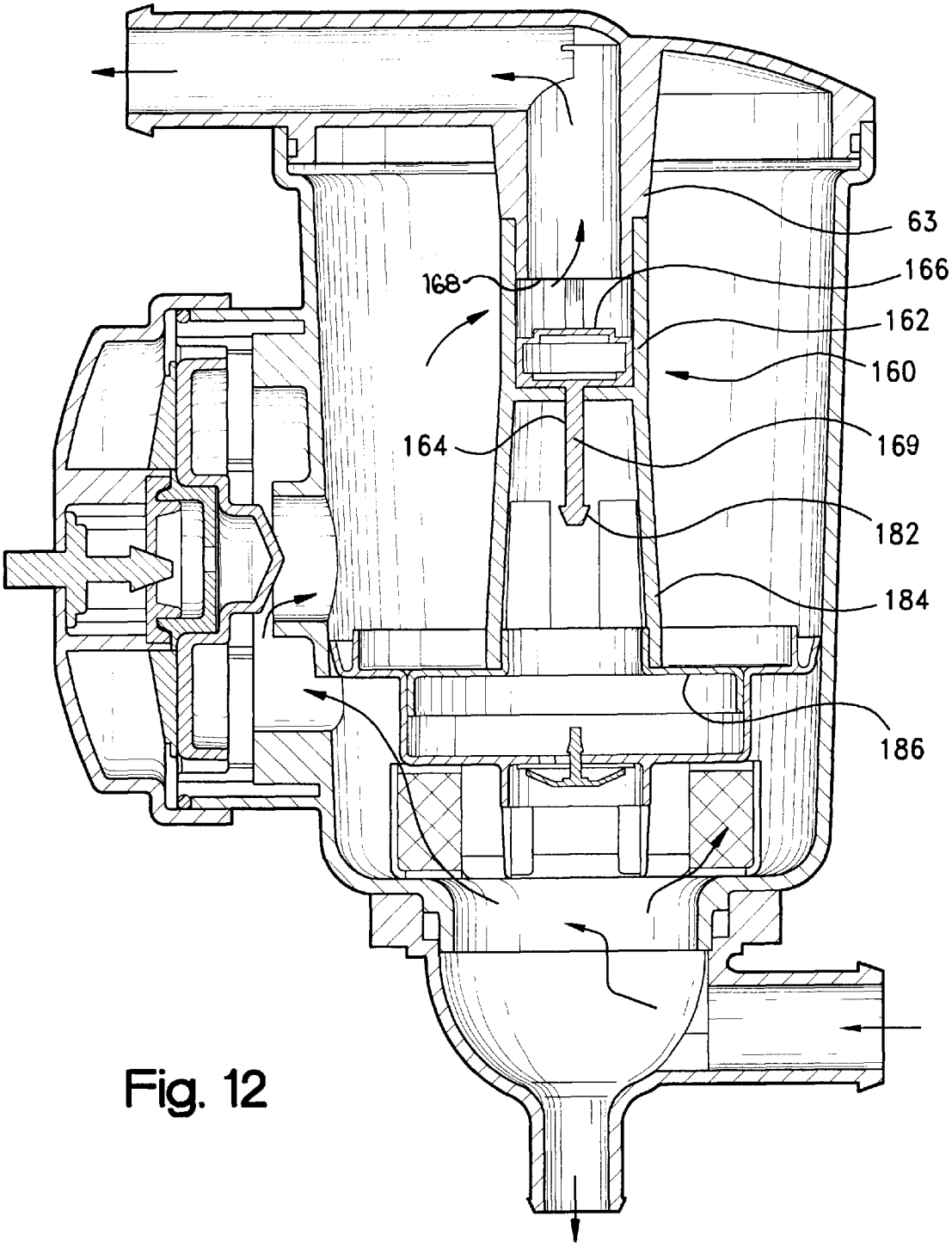
FIG. 12 is a cross-sectional side view of the crankcase emission control system, showing a further embodiment of the shut-off valve.
Figure 13:
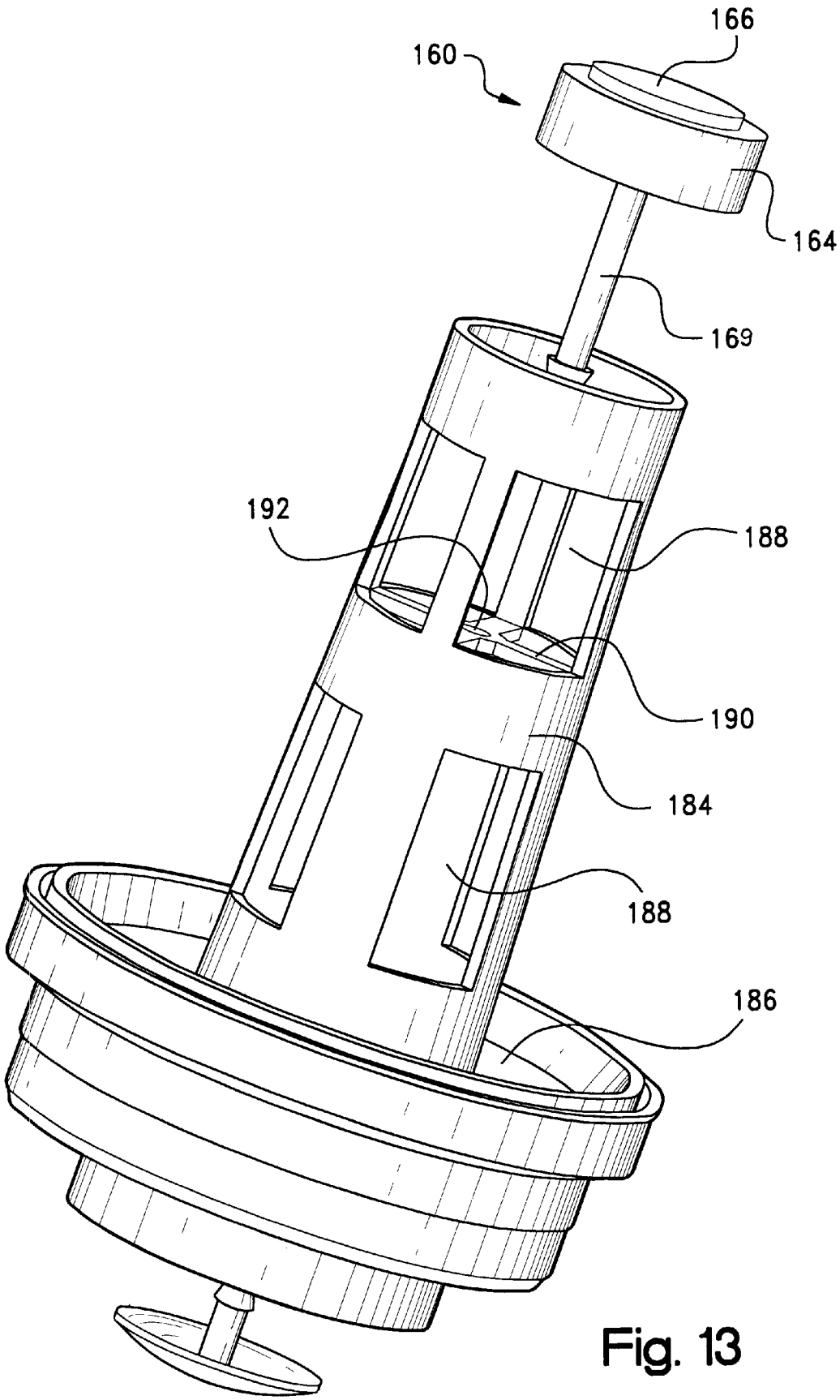
FIG. 13 is an elevated perspective view of the center tube assembly for the crankcase emission control system of FIG. 12.

Alternatively, the shut off valve 160 can be incorporated into a central support tube integral with the housing of the emissions control assembly. To this end, as illustrated in FIGS. 12 and 13, the central support tube is indicated generally at 184, and is fixed in an appropriate manner between the passage 63 and a lower end wall 186. It is noted that in this embodiment, a crankcase filter is not shown, as the crankcase filter is not necessary in all applications. Passages 188 are provided into central support tube 184. A support wall 190 is provided along the length of the central support tube, and includes a central circular opening 192. Similar to well area 172 described above, the support tube and wall 190 closely surround the float member, and guide member is slidingly received in opening 192, to ensure that the float member only has generally axially upward and downward movement.

As should be appreciated, the supporting body 164 of the float member and the seal 166 are each relatively straight forward and inexpensive to manufacture and assembly. Preferably the body 164 is formed unitarily (in one piece) from a material such as plastic, while seal 166 is formed of an appropriate elastomeric material.

Figure 14:
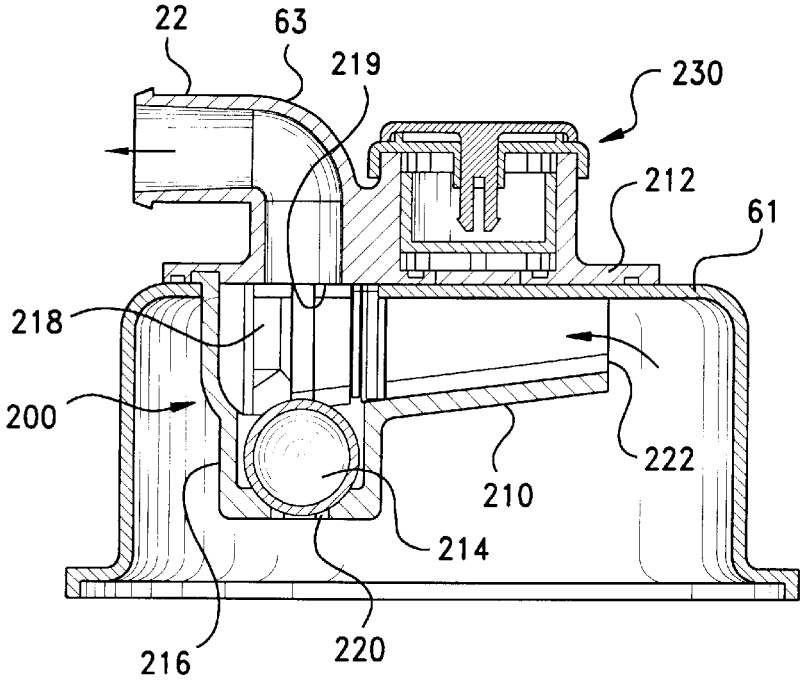
FIG. 14 is a cross-sectional side view of a portion of the crankcase emission control system, showing an integral shut-off valve and pressure relief valve according to a still further embodiment of the present invention.
Figure 15:
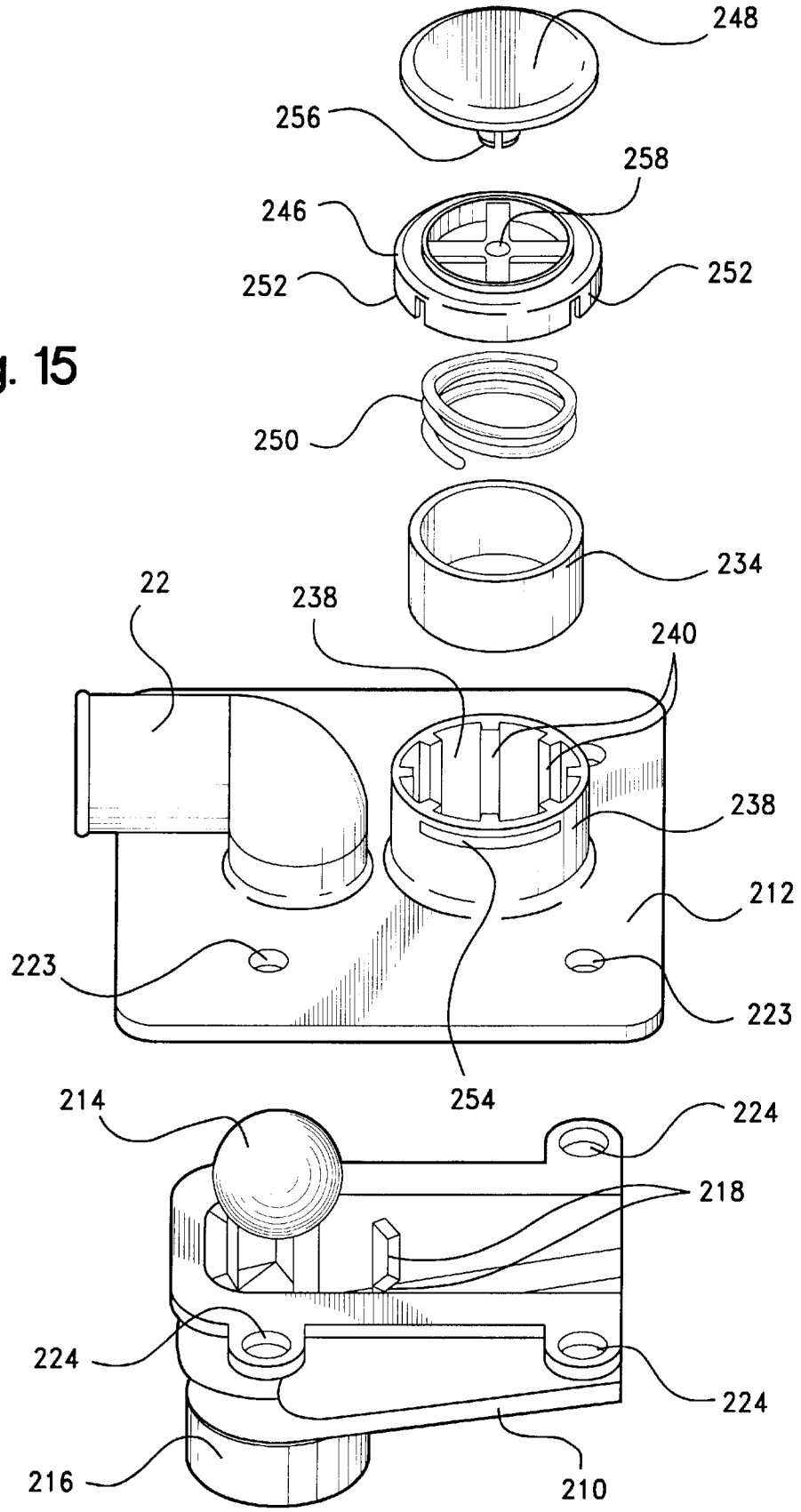
FIG. 15 is an exploded view of the integral shut-off valve and pressure relief valve of FIG. 14.
Figure 16:
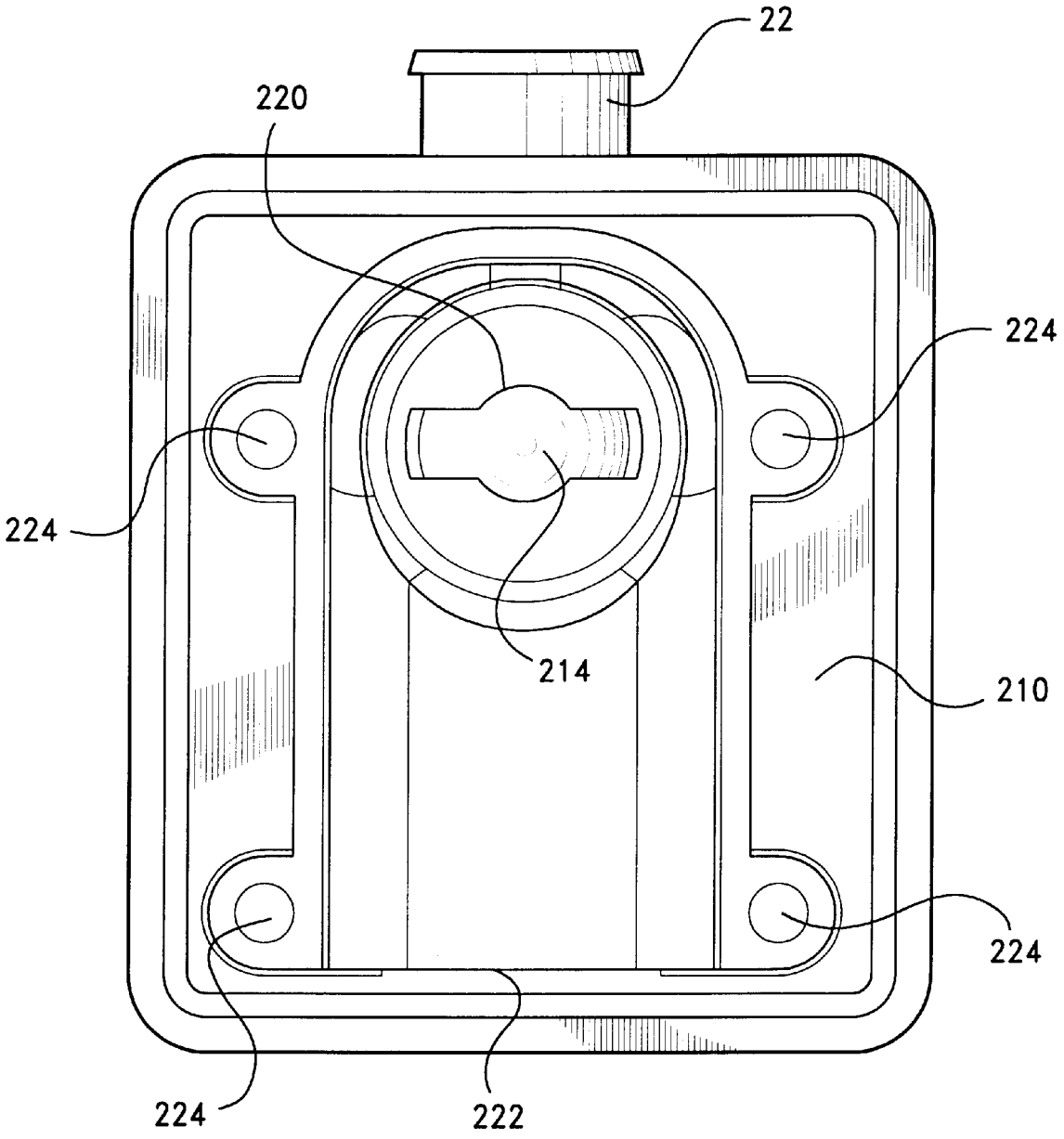
FIG. 16 is a bottom view of the integral shut-off valve and pressure relief valve of FIG. 14.

According to still further embodiments shown in FIGS. 14–19, the shut-off valve can be located at other locations in or around the housing. For example, as shown in FIGS. 14–16, a shut-off valve 200 is shown mounted to the cover 61 of the crankcase emission control assembly. In this embodiment, the shut-off valve includes a valve housing 210, a valve cover 212, and a hollow valve ball 214 supported between housing 210 and cover 212. Valve housing 210 includes a cylindrical guide chamber 216 which receives ball 214, and which includes a series of radially-extending flanges or ribs 218 to support and guide the ball. The ball is normally supported against the lower end of the guide chamber, and can move upward guided by ribs 218 into sealing contact with a valve seat 219 defined by cylindrical sleeve 63.

An opening 220 is provided in the lower end of guide chamber 216 to allow oil in the emission control assembly to flow into the shut-off valve. As can be seen in FIG. 16, opening 220 has a configuration which locates and seats valve ball 214, but which is not blocked by valve ball 214 when valve ball 214 is sitting against the opening. An opening 222 is also defined between the valve housing and the cover to allow gas (and oil) to flow into the shut-off valve. In this embodiment, gas outlet 22 is provided in cover 212.

Valve cover 212 can be mounted to valve body 210 in any appropriate manner, such as for example, using appropriate fasteners (bolts, etc.) received through holes 223 in cover 212 and corresponding holes 224 in valve body 210. The shut-off valve 200 can also be mounted to the cover 61 in any appropriate manner, such as by using the aforementioned fasteners. Typically the shut-off valve 200 is received within an appropriately-sized opening in the cover, and an O-ring seal 226 is provided between the valve cover 212 and the cover 61 of the crankcase emission control assembly to prevent gas and oil leakage.

The shut-off valve 200 shown in FIGS. 14–16 preferably has the same function, and operates in substantially the same manner, as the shut-off valve 160 described above with respect to FIGS. 10–14, that is, the valve ball 214 rises and falls with the level of oil in the housing of the crankcase emission control assembly. During normal engine operation, the gasses flow through opening 222 to outlet 22; but when oil is present in the emission control assembly, and rises to the level of the valve ball 214, the oil causes the valve ball to move up into sealing contact with valve seat 219, thus preventing the oil from passing to the engine. Oil will primarily enter the shut-off valve through opening 220 in the cylindrical guide 216, but may also enter through opening 222. As before, when the level of oil drops in the system, the valve ball will move away from the valve seat, and blow-by gasses can again pass back to the engine. A relief is preferably also provided in the ball valve or in the valve seat, as discussed previously.

To prevent pressure build-up in the shut-off valve when the valve ball is sealed against the valve seat, a pressure relief valve, indicated generally at 230, can also be provided. Pressure relief valve 230 includes an annular valve element 234 supported within a cylindrical valve chamber 236 of a valve sleeve 238. Valve sleeve 238 has valve cover 212 as its inner end wall, and includes a series radially-projecting flanges or ribs 240 which closely guide the valve element 234. Arcuate openings 242 (FIG. 15) are provided in valve cover 212 which correspond to the location of the valve element 234, such that valve element 234 completely closes the openings 242 when the element is located against the end wall of the valve sleeve.

Valve element 234 is enclosed within the sleeve 238 by an annular spring cap 246 and a circular dust cover 248. A compression spring 250 is located between spring cap 246 and valve element 234, to bias valve element 234 against cover 212 to fluidly seal openings 242. Cap 246 can be removably secured to sleeve 238 such as with flexible tabs 252 on cap 246 engaging radial flanges 254 on sleeve 238. Tabs 252 and flanges 254 allow easy removal of cap 246 for inspection of valve element 234 and spring 250. Dust cover 248 can have a central post 256 which is slidably received within a central opening 258 in cap 246 to prevent contaminants from entering the shut-off valve, but to allow pressure to escape to atmosphere.

When pressure in shut-off valve 200 increases above a predetermined amount when valve ball 214 is seated against the valve seat 219 (which amount can be chosen with an appropriate choice of spring 250), valve element 234 moves upwardly against spring 250 to uncover openings 242, and thereby allow gas to escape to atmosphere.

Figure 17:
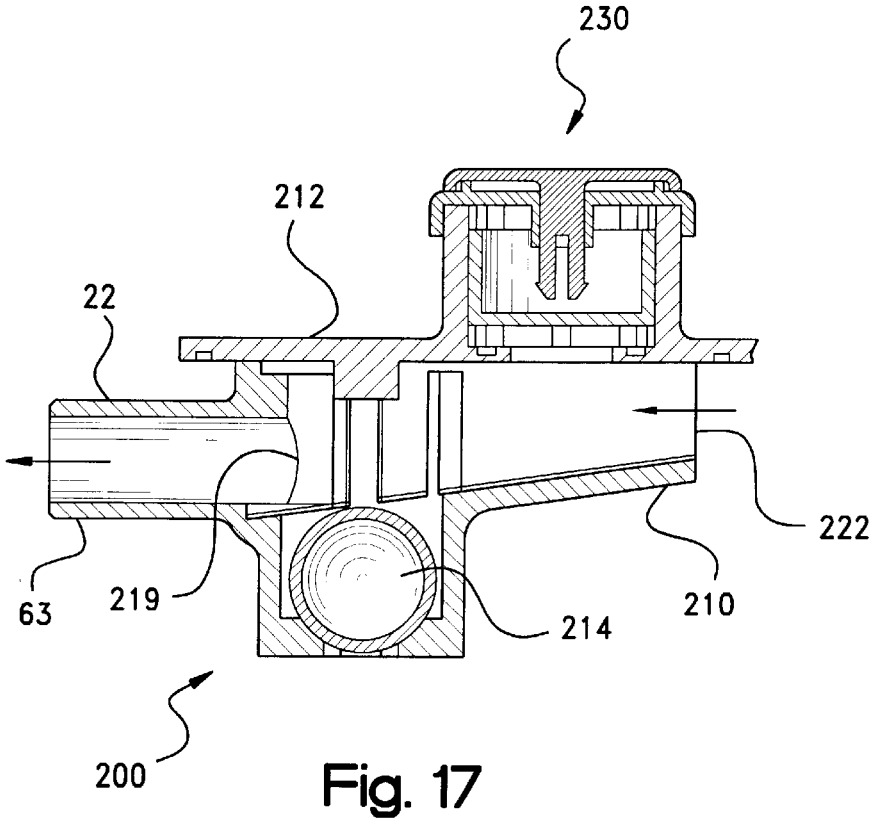
FIG. 17 is a cross-sectional side view of a further embodiment of the integral shut-off valve and pressure relief valve of FIG. 14.

An alternative form of the shut-off valve 200 is shown in FIG. 17. In this form, the gas outlet 22 is formed in valve body 210, rather than in cover 212. All other aspects and functions of the shut-off valve are the same as in FIGS. 14–16, with valve seat 219 formed in the inner end of sleeve 63, and covered by valve ball 214 when the valve ball rises with the level of oil in the system. Otherwise, gas can enter opening 222 and pass to outlet 22 as described previously.

Figure 18:
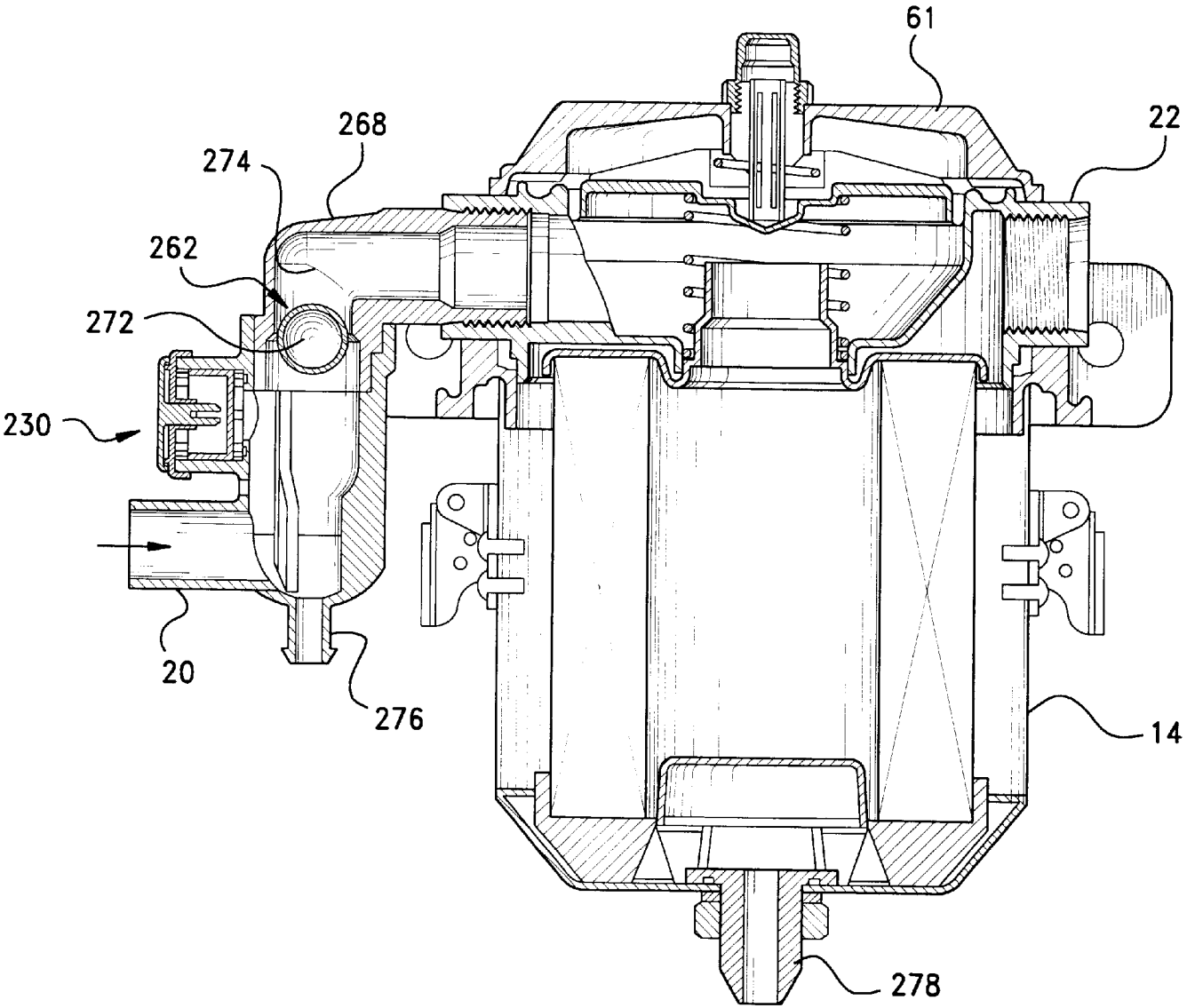
FIG. 18 is a cross-sectional side view of the crankcase emission control system, showing an integral shut-off valve and pressure relief valve according to a still further embodiment of the present invention.
Figure 19:
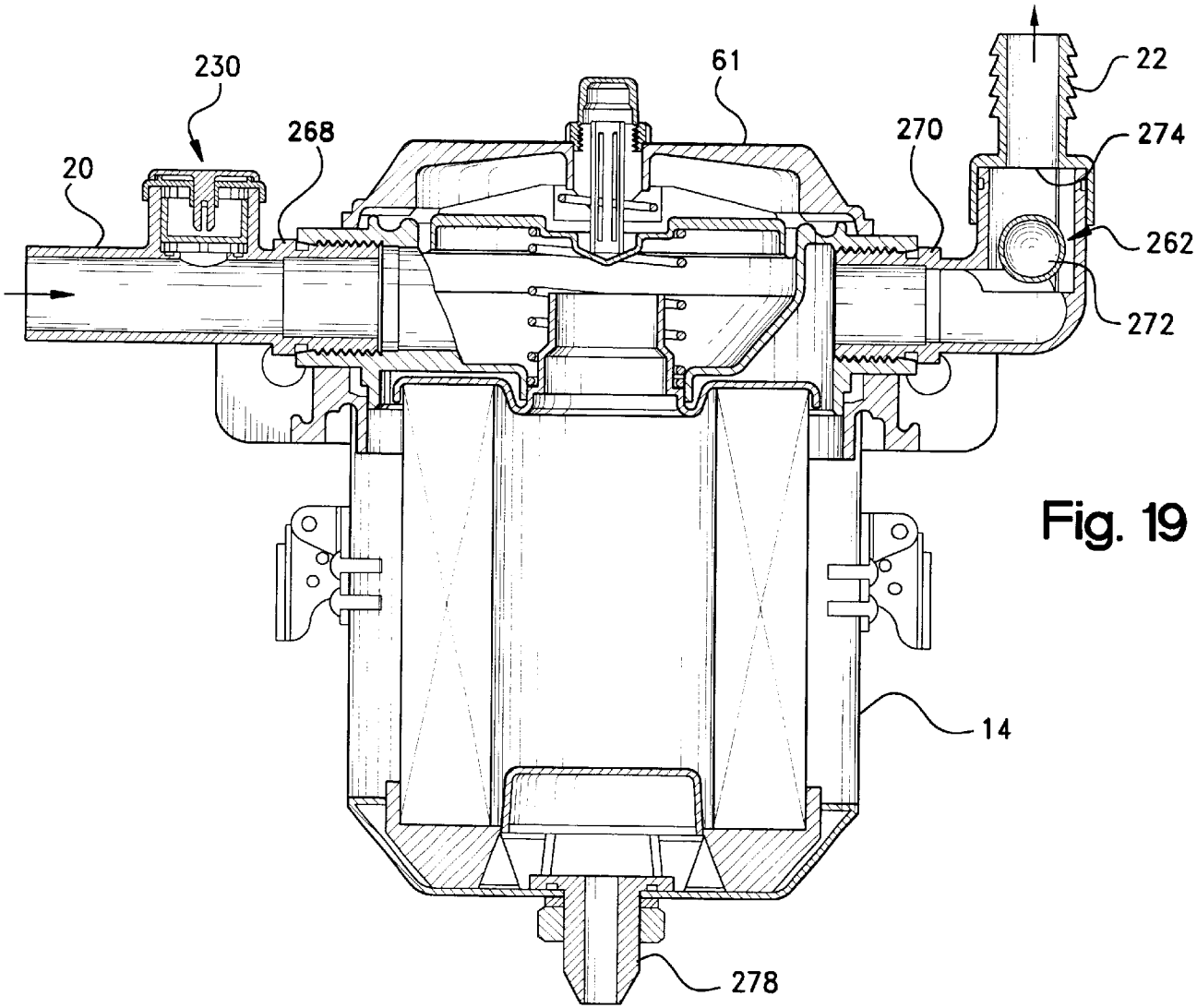
FIG. 19 is a cross-sectional side view of the crankcase emission control system, showing a shut-off valve and pressure relief valve according to a still further embodiment of the present invention.

Still further embodiments of the shut-off valve are shown in FIGS. 18 and 19. In these embodiments, a shut-off valve 266 can be located in the inlet fitting 268 (FIG. 18) or in the outlet fitting 270 (FIG. 19) for the emission control assembly 14. In either case, the shut-off valve can include a spherical hollow member, such as valve ball 272, guided within the fitting so as to rise and fall with the level of oil in the system. A valve seat 274 is provided in the fitting, and the valve ball seals against the seat when the oil rises in the system to prevent oil passing to the engine. Fittings 268, 270 are preferably otherwise conventional fittings, and can be threaded into sealing attachment with the cover 61 of the assembly, or at other appropriate locations in the assembly.

In the event the shut-off valve is located in inlet fitting 268, the inlet fitting also includes a drain 276. The drain 276 is fluidly connected with the crankcase to return oil to the engine. Otherwise, or in addition, a drain 278 can be provided in the lower end of the filter housing to return oil to the engine.

The pressure relief valve 230, preferably of the same structure as described above with respect to FIGS. 14–16, is located upstream of the shut-off valve 262. The pressure relief valve could be located in inlet fitting 268 upstream from a shut-off valve located in the inlet fitting (FIG. 18); upstream from a shut-off valve located in the outlet fitting (FIG. 19); or the pressure relief valve could be located in outlet fitting 270 with the shut-off valve located further downstream. As described above, pressure relief valve 230 exhausts excess pressure to atmosphere when ball valve 272 is sealed against valve seat 274.

As mentioned above, the shut-off valve 200 (alone or in conjunction with pressure relief valve 230), can be used with or without a filter element in the emission control assembly, depending upon the particular application.

The crankcase emission control assembly of the present invention thereby prevents oil passing through the crankcase emission control system and being ingested by the engine; and still provides a system that is compact and combines various components into a single integrated unit, is efficient, and is simple and inexpensive to manufacture.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A replaceable filter element removably positionable in a housing for a crankcase emission control system, the replaceable filter element comprising:

a ring of filter media circumscribing a central cavity and having a first end and a second end;

a first annular end cap sealingly attached to the first end of the filter media ring, said first end cap having a central opening into the central cavity of the filter media ring;

a second annular end cap sealingly attached to the second end of the filter media ring; and a shut off valve supported and carried by said first end cap, said shut off valve including a float member which can rise and fall with the level of oil in the element when the element is located in a housing.

2. The replaceable filter element as in claim 1, wherein the float member includes a supporting body and a resilient seal.

3. The replaceable filter element as in claim 2, wherein the supporting body and resilient seal together define an empty cavity.

4. The replaceable filter element as in claim 3, wherein the first end cap includes a well area extending inwardly into the central cavity of the element and having structure which closely surrounds the float member.

5. The replaceable filter element as in claim 4, wherein the supporting body includes an elongated guide member, and the first end cap includes structure cooperating with the guide member to constrain the float member to generally axial movement in the element.

6. The replaceable filter element as in claim 5, wherein a catch is provided at the distal end of the guide member, and the well area includes an end wall with a central opening, the catch slidingly received in the central opening and cooperating with the end wall to prevent the guide member from being removed from within the opening.

7. The replaceable filter element as in claim 1, wherein the supporting body includes an elongated guide member, and the first end cap includes structure cooperating with the guide member to constrain the float member to generally axial movement in the element.

8. The replaceable filter element as in claim 1, wherein the first end cap includes a well area extending inwardly into the central cavity of the element and having structure which closely surrounds the float member.

9. A crankcase emission control system, the crankcase emission control assembly comprising a housing, a first port in the housing receiving blow-by gasses from an engine crankcase, and a second port in the housing directing substantially oil-free gasses to an air intake, a filter element in the housing for removing oil from the blow-by gases passing through the housing, and a shut off valve including a float member which can rise and fall with the level of oil in the system and move to a closed position to prevent oil in the housing from passing through the second port to the air intake when the oil rises above a predetermined level.

10. The crankcase emission control system as in claim 9, wherein the float member includes a supporting body and a resilient seal.

11. The crankcase emission control system as in claim 10, wherein the supporting body and resilient seal together define an empty cavity.

12. The crankcase emission control system as in claim 11, wherein the shut-off valve is supported internally of the housing and the float member can seal against a valve seat to prevent oil in the housing from passing through the second port to the air intake.

13. The crankcase emission control system as in claim 12, wherein the supporting body includes an elongated guide member, and the housing includes support structure cooperating with the guide member to constrain the float member to generally axial movement in the housing.

14. The crankcase emission control system as in claim 13, wherein the housing includes a central support tube extending centrally within the housing, said central support tube having structure which closely surrounds the float member.

15. The crankcase emission control system as in claim 14, wherein a catch is provided at the distal end of the guide member, and the support structure includes an end wall with a central opening, the catch slidingly received in the central opening and cooperating with the end wall to prevent the guide member from being removed from within the opening.

16. The crankcase emission control system as in claim 9, wherein the supporting body includes an elongated guide member, and the housing includes structure cooperating with the guide member to constrain the float member to generally axial movement in the housing.

17. The crankcase emission control system as in claim 9, wherein the housing includes a central support tube extending centrally within the housing, said central support tube having structure which closely surrounds the float member to constrain the float member to generally axial movement in the housing.

18. The crankcase emission control system as in claim 9, wherein the shut-off valve is supported internally of the housing and can seal against a valve seat to prevent oil in the housing from passing through the second port to the air intake.

19. The crankcase emission control system as in claim 18, wherein the valve seat is in the second port.

20. The crankcase emission control system as in claim 9, wherein the float member comprises a ball member.

21. The crankcase emission control system as in claim 9, further including a relief valve upstream from the shut off valve and operable when the shut off valve is in the closed position to relieve excess pressure in the system.

22. The crankcase emission control system as in claim 21, wherein the shut off valve is located in the first port.

23. The crankcase emission control system as in claim 21, wherein the shut off valve is located in the second port.

24. The crankcase emission control system as in claim 22, wherein the relief valve is located in the first port.

25. The crankcase emission control system as in claim 21, wherein the shut off valve and relief valve are supported in an inlet fitting to the housing.

26. The crankcase emission control system as in claim 25, and further including an oil drain port in the inlet fitting to return oil back to the crankcase.

27. The crankcase emission control system as in claim 21, wherein the float member is a ball member.

28. An internal combustion engine, comprising:

an engine block with an inlet and an outlet;

an induction system communicating with the inlet to the engine block; and a crankcase emissions control system, the crankcase emission control system comprising a housing having a first port receiving gasses from the outlet of the engine block, and a second port downstream from the first port directing substantially oil-free gasses back to the engine block, and a shut off valve including a float member which can rise and fall with the level of oil in the housing and move to a closed position to prevent oil in the housing from passing through the second port to the engine block when the oil rises above a predetermined level.

29. The internal combustion engine as in claim 28, and further including a relief valve upstream from the shut off valve and operable when the shut off valve is in the closed position to relieve excess pressure in the system.

30. An internal combustion engine, comprising:

an engine block with an inlet and an outlet;

an induction system communicating with the inlet to the engine block; and a filter assembly, the filter assembly comprising a housing having a first port receiving blow-by gasses from the outlet of the engine block, and a second port directing substantially oil-free gasses to the induction system; and a filter element, the filter element including a ring of filter media circumscribing a central cavity and having a first end and a second end;

a first annular end cap sealingly attached to the first end of the filter media ring, said first end cap having a central opening into the central cavity of the filter media ring;

a second annular end cap sealingly attached to the second end of the filter media ring, and a shut off valve supported and carried by said first end cap, said shut off valve including a float member which can rise and fall with the level of oil in the housing and seal against the second port to prevent oil in the housing from passing through the second port to the induction system.

31. The crankcase emission control system as in claim 30, wherein the housing includes structure which closely surrounds the float member to constrain the float member to generally axial movement in the housing.

32. The internal combustion engine as in claim 28, further including:

a filter element in the housing for removing oil from the gases passing through the housing.

* * * * *